United States Patent [19]

Brown

[11] 4,351,254

[45] Sep. 28, 1982

[54] SEWING MACHINE NEEDLE POSITIONING

[75] Inventor: Jack Brown, Union, N.J.

[73] Assignee: The Singer Company, Stamford, Conn.

[21] Appl. No.: 271,445

[22] Filed: Jun. 8, 1981

[51] Int. Cl.[3] ..... D05B 3/02; D05B 69/22

[52] U.S. Cl. ..... 112/158 E; 112/275

[58] Field of Search ..... 112/158 E, 275, 277, 112/220

[56] References Cited

U.S. PATENT DOCUMENTS

| | | | |
|---|---|---|---|
| 4,150,634 | 4/1979 | Brown et al. | 112/275 |
| 4,173,193 | 11/1979 | Morinaga et al. | 112/275 |
| 4,262,614 | 4/1981 | Sugaya et al. | 112/158 E |

*Primary Examiner*—Peter P. Nerbun

*Attorney, Agent, or Firm*—Edward P. Schmidt; Robert E. Smith; Edward L. Bell

[57] ABSTRACT

In an electronically controlled sewing machine having an arm shaft position sensor signalling release of feed data and of needle position data at opposite extremes of endwise reciprocation of a needle bar, depression of a needle up or needle down position button will implement a slow speed drive circuit, and a fast stop brake circuit will stop the needle bar immediately upon the occurrence of a signal from the arm shaft position sensor corresponding to the selected needle position button.

5 Claims, 4 Drawing Figures

SEWING MACHINE NEEDLE POSITIONING

BACKGROUND OF THE INVENTION

This invention is in the field of sewing machines; more particularly, it is concerned with a means for stopping the sewing machine with the sewing needle thereof in a selected up or down needle position.

Needle positioning is common in industrial sewing machines, and has also recently been implemented in some household sewing machines. Systems are known in the prior art industrial sewing machines utilizing sensors for needle position, together with auxiliary low speed motors, or low speed operation of a main motor, which motor is driven until a selected needle position is sensed whereupon a mechanical or dynamic braking is implemented. In household sewing machines, needle positioning has been implemented by utilizing sensors using magnets and reed switches or Hall effect devices. None of these prior art devices has been entirely efficacious, and improved and more cost effective systems are constantly being sought.

What is desired are devices which are economical and simple of design and which are readily adaptable to a wide range of electronically controlled sewing machines.

SUMMARY OF THE INVENTION

The above objects have been attained in an electronically controlled sewing machine having an arm shaft position sensor arranged to signal by a change of state the release of feed data from an LSI logic when the sewing needle is approximately at bottom dead center, or to signal by a second change of state the release of needle position data from the LSI logic when the sewing needle is approximately at top dead center. A pair of buttons are provided in order to permit the selection of a needle up position or a needle down position when the sewing machine stops. Depression of a selected button will enable a slow speed drive circuit and disable a needle bar release solenoid in order to obviate the possibility of needle bar release, thereby to permit the needle bar to move to the selected position. The sewing machine motor will run at slow speed until the arm shaft position sensor indicates a change in state corresponding to the selected needle position. Thereupon, the slow speed drive circuit is disabled and fast stop braking is implemented, the combination of the slow speed and fast stop braking drastically limiting the amount of coast. A motor braking arrangement is utilized similar to that disclosed in the U.S. Pat. No. 4,243,919, issued on Jan. 6, 1981 to Brown. Circuits are provided for implementing the needle up selection or the needle down selection which are responsive to the change in state of the arm shaft position sensor.

The invention accordingly comprises the constructions hereinafter described, the scope of the invention being indicated in the following claims.

Figure 1:
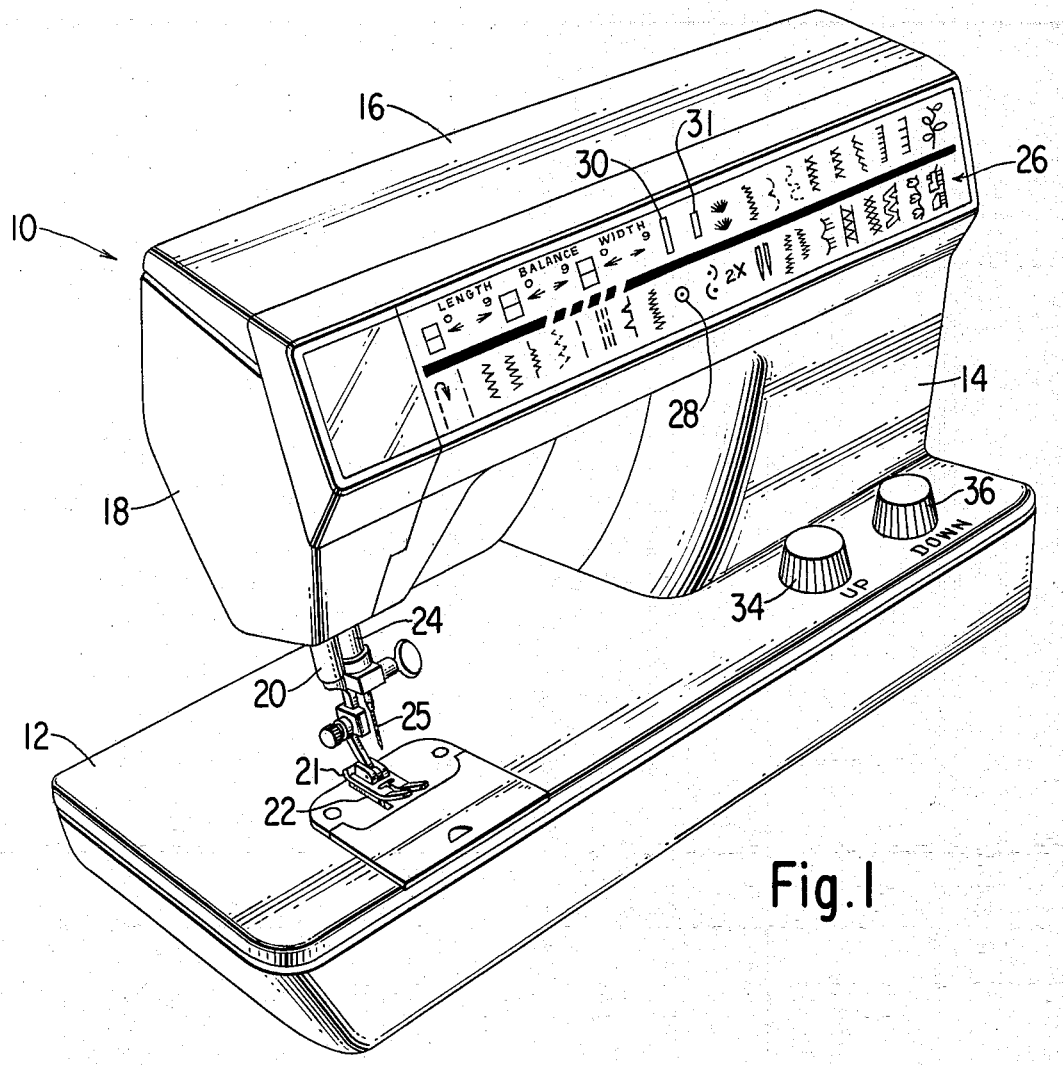
FIG. 1 is a perspective view of a sewing machine incorporating the present invention.
Figure 2B:
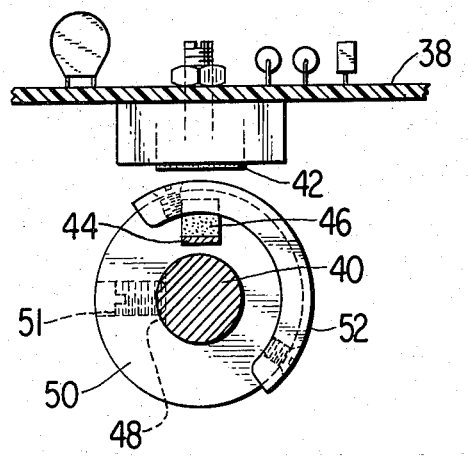
Figure 2A:
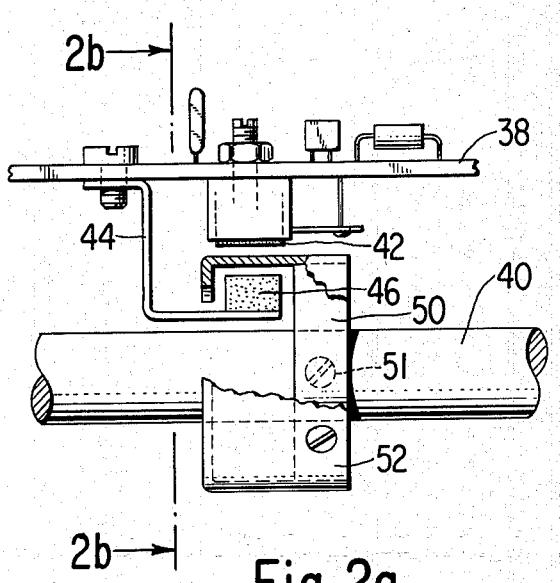
Figure 3:
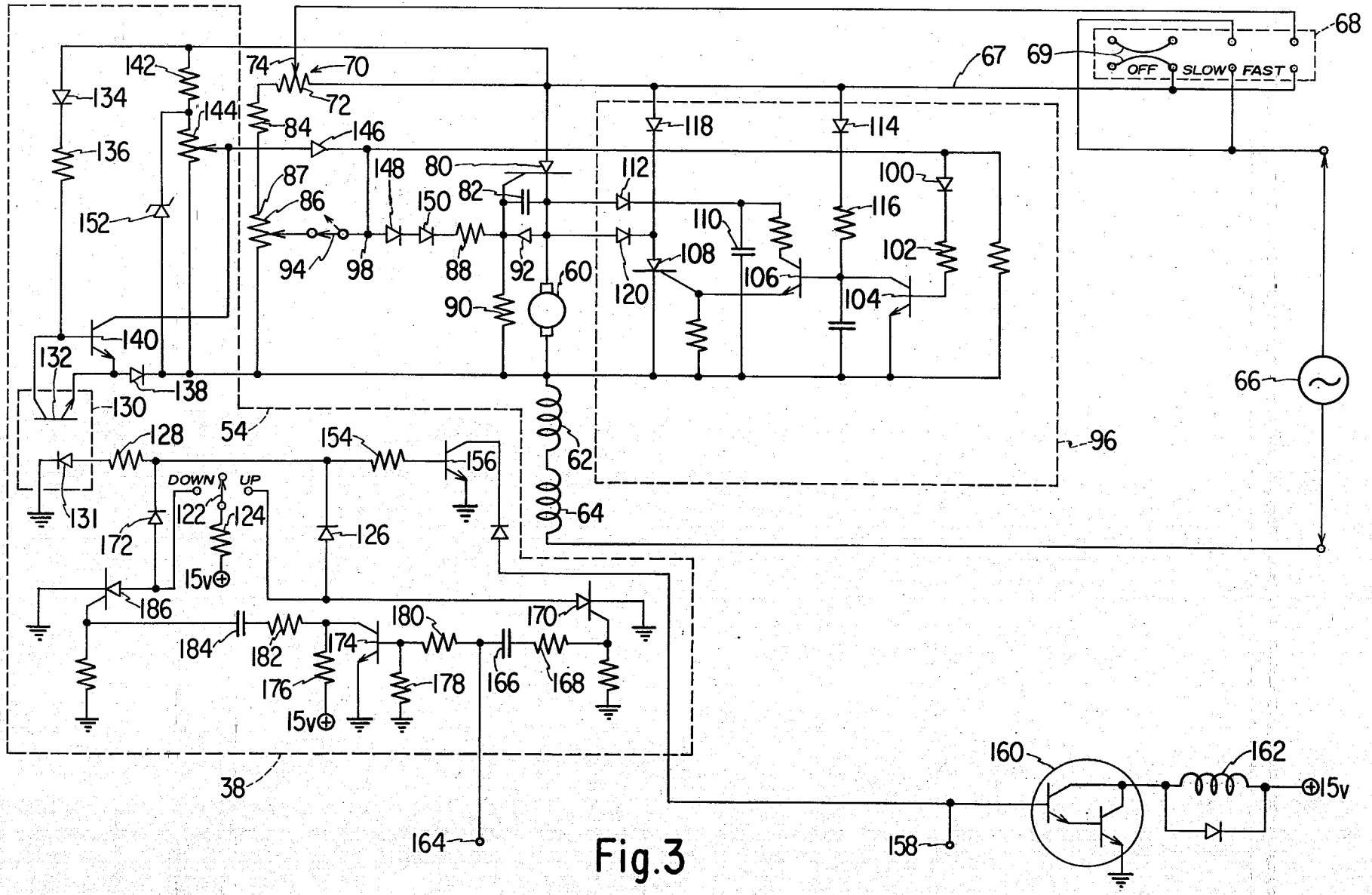

FIG. *2a* is a frontal view of a arm shaft position sensor utilized in the sewing machine shown in FIG. 1;

FIG. *2b* is a cross sectional view of the arm shaft position sensor taken substantially along the line *2b—2b* in FIG. *2a;* and, FIG. 3 is a circuit diagram which may be utilized to control the sewing machine of FIG. 1 in order to attain the improvements of the invention.

Referring now to FIG. 1 there is shown a sewing machine 10 including a bed 12 with a standard 14 rising from one end thereof. The standard 14 supports a bracket arm 16 overhanging the bed 12, the bracket arm terminating in a head end 18. Within the head end 18 there is supported a presser bar 20 having a presser foot 21 supported on the end thereof. The presser foot 21 is urged by the presser bar 20 against the bed 12 for cooperation with feed dogs 22, part of a feed system (not shown) supported in the bed, all as is well known in the sewing machine art. The head end 18 also supports therein a needle bar 24 supporting a sewing needle 25 in the end thereof, the needle bar being supported in a gate arrangement as is disclosed in the U.S. Pat. No. 3,872,809, issued on Mar. 25, 1975 to the assignee of record, which patent is hereby incorporated by reference herein. By way of explanation the needle bar gate arrangement includes a needle bar release device having a latch release member that is movable by a solenoid into engagement with a coupling member to unlatch the coupling member from a needle bar drive member. The device also includes biasing springs for elevating the needle bar 24 to an uppermost position upon unlatching of the coupling member from the needle bar drive member.

The sewing machine 10 further includes within the bracket arm 16 capability for electronically controlling the lateral position of the sewing needle 25 and the feeding rate implemented by the feed dogs 22. Capability for several ornamental patterns is retained in a solid state memory which is part of the circuitry within the bracket arm 16, which circuitry further includes logic for determining, and implementing a selection from among the various capabilities displayed in the selection board 26 on the forward side of the bracket arm. For a fuller understanding of an electronically controlled machine, the reader is referred to the U.S. Pat. No. 3,872,808, issued on Mar. 25, 1975 to the assignee of record in this case, which is hereby incorporated by reference herein.

Among the selection capabilities presented by the selection board 26 is a single pattern capability represented by the single pattern insignia 28. Such capability is described in the U.S. Pat. No. 3,987,739, issued on Oct. 26, 1976 to Wurst et al and owned by the assignee of record, which patent is hereby incorporated by reference herein. In that patent there is disclosed a means by which an operator may limit the operation of the sewing machine to stitching of a single execution of any selected stitch pattern. After the stitching of a single pattern has been completed, further operation of the sewing machine is inhibited by suspension of needle reciprocation, needle jogging and work feeding motion.

Also disclosed on the selection board 26 are the insignia for large buttonhole 30 and small buttonhole 31. Selection of a buttonhole insignia 30, 31 automatically selects the single pattern capability without the necessity for the selection of the single pattern insignia 28. The selection board 26 operates as is disclosed in U.S. Pat. No. 4,242,667, issued on Dec. 30, 1980 to Hunts, which patent is owned by the assignee of record and is incorporated by reference herein. This patent discloses the use of proximity switch pairs so as to obtain a high density arrangement. Thus, each insignia in the selection board 26 is responsive to the touch of an operator's finger to actuate a pair of proximity elements which are unique for each insignia. The selection of proximity elements is decoded in a decoder, the output of which communicates with the other electronic elements within the bracket arm 16 to produce a selected result.

Supported on the bed 12 adjacent the standard 14 are two buttons 34, 36 labeled, respectively, UP and DOWN. These buttons 34, 36 are used to select a desired position of the sewing needle 25 when the sewing machine 10 stops running, as will be explained below.

Referring now to FIGS. *2a* and *2b*, there is shown an electronic circuit board 38, part of the electronic circuitry retained in the bracket arm 16. The circuit board 38 and the components supported thereon are supported in the bracket arm 16 adjacent the horizontal arm shaft 40 for the sewing machine. As is well known in the sewing machine art the horizontal arm shaft 40 revolves once for each penetration of the work material by the sewing needle 25. Supported on the circuit board 38 and extending therefrom towards the horizontal arm shaft 40 is a Hall effect device 42. A small bracket 44 is attached to the circuit board 38 adjacent the Hall effect device 42, the bracket being formed to extend around the Hall effect device and support a magnet 46 adjacent the Hall effect device. The horizontal arm shaft 40 is provided with a flat 48 thereon for receiving a set screw 51 extending through a collar 50. The collar 50 supports a shield 52 which extends between the magnet 46 and Hall effect device 42 for approximately 180° of the rotation of the horizontal arm shaft 40. The shielding of the Hall effect device 42 from the magnet 46 for approximately 180° is apparent from FIG. *2b* which shows the relationship of the shield 52 to the Hall effect device and magnet. The result of this relationship is that the magnetic field from the magnet 46 is diverted by the shield 52 for approximately 180° of rotation of the arm shaft 40. By positioning of the flat 48 on the horizontal arm shaft 40 the shield 52 is arranged so that the Hall effect device 42 is in one state from substantially a needle up position to a needle down position, and in a second state from substantially a needle down position to the needle up position. The change of state of the Hall effect device 42 at needle up or needle down position, is utilized to indicate a release of bight information or of feed information from the electronic devices retained in the bracket arm 16. A system is also proposed herein which will permit output of the Hall effect device 42, together with other electronic devices, to permit the sewing machine 10 to be stopped with the sewing needle 25 in a selected up or down position. Particulars of this arrangement are disclosed below in the discussion of the circuit diagram of FIG. 3.

In FIG. 3 there is shown an electronic circuit diagram for powering an SCR motor of a sewing machine, which circuit may be included with the other circuits retained in the bracket arm 16 of the sewing machine. The circuit diagram of FIG. 3 includes as part thereof, the motor braking arrangement disclosed in the commonly owned U.S. Pat. No. 4,243,919, issued on Jan. 6, 1981 to Brown which is hereby incorporated by reference herein. In that patent, there is disclosed an SCR motor speed control system having provision therein for fast braking of the motor. A circuitry senses when it is desired to stop the motor and simultaneously short circuits the motor armature and applies half-wave rectified line voltage to the motor field windings. To the circuitry disclosed in the above referenced patent, there has been applied a slow speed drive circuit enclosed by the dotted line 54 in FIG. 3. Externally of the dotted lines are shown the inputs from an LSI (large scale integrated circuit), part of the electronic devices retained within the bracket arm 16 of the sewing machine. There is also disclosed a circuit to implement the needle bar release i.e., for actuating the device of the U.S. Pat. No. 3,872,809 of Adams et al referred to above.

Referring to FIG. 3, there is shown a circuit including the capability for controlling the speed of a motor having an armature winding 60 and field windings 62 and 64, as disclosed in the above referenced patent. These motor windings are serially connected to an alternating power supply 66 through a speed range selector switch 68. The power supply 66 may be a commercially available 115 volt 60 hertz power. The selector switch 68 permits the selection of a slow speed range which operates through the entire resistance 72 of a potentiometer 70, or with the slider 69 in the fast position, a portion of the resistance 72 may be bypassed by the wiper 74. In either event, the motor braking arrangement and a silicon controlled rectifier (SCR) 80 are supplied with the full output of the power supply 66.

The SCR 80, armature windings 60 and field windings 62, 64 are connected directly across power supply 66. When the SCR 80 is triggered into conduction, current from the power supply 66 flows through the armature winding 60 and field windings 62, 64. To trigger the SCR 80, there is supplied a firing circuit which includes the charging capacitor 82 and current controlling circuit comprising the resistors 84, 86, 88 and 90. Within a positive half cycle from the power supply 66 the capacitor 82 is charged to the threshhold value for the SCR 80, at which point the SCR begins to conduct and the motor begins to operate. Motor speed is controlled by varying the position of the wiper on the potentiometer 86, the closer that wiper is to the point 87 the less the resistance in the charging circuit and the faster the capacitor charges. The motor therefore will run faster since more of the positive half cycle of power is flowing through the SCR 80. Conversely, the further that the wiper is from the point 87, the greater the charging path resistance and the slower the charging rate of the capacitor 82. The motor will run slower. During negative half cycles of the power supply 66, the capacitor 82 discharges through the gate cathode path of the SCR 80 and through the resistor 90 and the armature winding 60. The diode 92 prevents excessive reverse voltage from appearing across the cathode gate of the SCR 80.

As used in the sewing machine, the potentiometer 86 is carried within a foot controller which causes the wiper therein to be moved from the furthest extreme of the potentiometer towards the point 87. The foot controller additionally carries a switch 94 which is in the open position until an operator's foot depresses the foot controller whereupon the switch is closed. In a sewing machine it is desirable that the sewing motor thereof come to a stop quickly when pressure is removed from a foot controller in order to avoid any further stitches which are not desired. To accommodate this desire, a braking circuit is shown within the dotted line 96 which was subject of the above referenced U.S. Patent on Motor Braking Arrangement. Briefly, with the foot controller depressed, i.e., with the wiper of the potentiometer 86 displaced towards the point 87, a voltage at point 98 causes current to flow through the diode 100 and resistor 102 into the base of the transistor 104, causing conduction thereof. When the transistor 104 conducts, current is diverted from the base of transistor 106 thereby not permitting transistor 106 to conduct current to the gate of SCR 108 so that the SCR does not conduct. Thus, while the motor is running, the armature voltage is used to charge capacitor 110 through the diode 112, this capacitor being able to discharge only when the transistor 106 is conducting.

Upon release of the foot controller and an opening of the switch 94, the flow of current through the diode 100 and resistor 102 to the base of the transistor 104 is interrupted, making transistor 104 non-conductive. A positive voltage from the power supply 66 on line 67 will cause current to flow through diode 114 and resistor 116 to the base of transistor 106 making transistor 106 conductive since its base current is no longer diverted by transistor 104. The capacitor 110 is thus discharged through transistor 106 triggering the SCR 108 into conduction so that current flows through the diode 118 and through the SCR 108 to the field windings 62 and 64. At the same time, the armature winding 60 is short circuited through the diode 120 and SCR 108. The simultaneous short circuiting of the armature and application of power to the field windings causes the motor to brake very quickly.

As indicated above, the motor braking arrangement thus far disclosed is set forth in greater detail in U.S. Pat. No. 4,243,919 to which the reader is referred for more complete exposition thereof. To the circuit disclosed in that patent, a slow speed drive and needle positioning circuit 54 is added which includes a three position switch 122 actuated by means of the up and down buttons 34, 36 on the bed 12 of the sewing machine 10 from a null position. The three position switch 122 is spring biased to return to the null position upon release of pressure from the up and down buttons 34, 36, respectively. Depressing the up button 34, and retaining the same in the depressed position, applies a current from plus 15 volts through resistor 124, the up connection of the switch 122, diode 126, and resistor 128 to the input LED 131 of photoisolator 130. Thereby, the output transistor 132 of the photoisolator 130 is made to conduct. When the polarity of the voltage on line 67 is positive, current will flow through diode 134, resistor 136, through the collector-emitter junction of the output transistor 132 of photoisolator 130, and through diode 138. Current is thus diverted from the base of transistor 140, thereby preventing current flow from the collector to the emitter of this transistor. Thus, current flows from line 67 through resistor 142, through a portion of slow speed trim pot 144 and through wiper of trim pot 144, through diodes 146, 148 and 150 and through resistor 88 to the gate of SCR 80. The motor will run at the speed determined by setting of the wiper on the slow speed trim pot 144. A Zener diode 152 reduces speed variations due to line voltage changes. Simultaneously, power is supplied through diode 146 to the diode 100 and resistor 102 to the base of transistor 104 so as to implement conduction thereof to make transistor 106 non-conductive, thereby disabling the braking arrangement described above and in the referenced patent.

Slow speed operation of the motor contemplates non-actuation of the foot controller, i.e., the wiper of potentiometer 86 is located furthest from the point 87 and switch 94 is in the open position. The wiper of the slow speed trim pot 144 may be adjusted to obtain a speed of operation which will invariably provide a successful needle positioning. If the foot controller is actuated, a first effect is to close the switch 94 and establish a brake disabling circuit which overrides the needle positioning capability. Thus, selection of a needle position and implementation thereof must be made, as it usually is made, when the foot controller is not depressed.

Simultaneously with the above, current also flows from the plus 15 volts through resistor 124, the up contact of switch 122, the diode 126 and a resistor 154 to the base of transistor 156. The transistor 156 thus made conductive bypasses current from pin 158 of the LSI which would normally go to Darlington pair 160 to activate a needle bar release solenoid 162. Thus, the needle bar release solenoid 162 is effectively disabled and prevented from operation in order to insure that the needle bar 24 may be driven to a selected up or down position of the sewing needle 25.

When the horizontal arm shaft 40 of the sewing machine rotates to a point where the needle bar 24 and sewing needle 25 affixed thereto is elevated to an uppermost position, the state of the Hall effect device 42 changes, which change is felt as a change from a negative voltage to a positive voltage on pin 164 from the LSI. A small current flows from the LSI pin 164 to the capacitor 166 and through a resistor 168 to the gate of SCR 170, causing triggering of the SCR. This trigger current will cease when capacitor 166 is charged, but the SCR 170 will continue to conduct between anode and cathode. Thereupon, current flows from plus 15 volts through resistor 124, the up contact of the switch 122 and from anode to cathode of SCR 170. Because of this current bypass, no current flows through diode 126 and resistor 128 to input LED 131 of photoisolator 130, thus disabling the slow speed drive by permitting the voltage on line 67 to bias the base of the transistor 140 into conduction by way of diode 134 and resistor 136. Current is diverted from the wiper of slow speed trim pot 144, preventing charging of capacitor 82 and triggering of SCR 80. The slow speed drive having been disabled and the foot controller not being depressed thereby leaving the switch 94 open, fast stop braking is imposed on the motor because current ceases to flow through diode 100 and resistor 102 to the base of transistor 104 which had disabled the braking arrangement. Current also ceases to flow to the base of transistor 156, which transistor becomes non-conductive permitting the Darlington pair 160 to operate the needle bar release solenoid 162 if desired.

If the needle down button 36 had been selected, current would flow from plus 15 volts through resistor 124, through the down contact of switch 122, through diode 172 and resistor 128 to the input LED 131 of photoisolator 130. Activation of the input LED 131 will make the output transistor 132 of the photoisolator 130 conductive so as to divert current from the base of the transistor 140 to make it non-conductive, and so enable the slow speed drive circuit. The connection of the resistor 154 to the diode 172 will make the transistor 156 conductive so as to divert any signal from pin 158 of the LSI calling for actuation of the needle bar release solenoid. At the needle down position, the circuitry connected to the Hall effect device 42 will cause the pin 164 from the LSI to change from a positive voltage to a negative voltage which is connected to an inverter stage comprising transistor 174 and resistors 176, 178, 180. When the output on pin 164 changes from a positive voltage to a negative voltage, the output voltage on the collector of transistor 174 goes from a very low value due to conduction of the transistor 174, to a high positive value due to non-conduction thereof. The high positive value on the collector of transistor 174 allows trigger current to flow through the resistor 182 and the capacitor 184 to the gate of SCR 186. With the SCR 186 made conductive at needle down position, the current from plus 15 volts through resistor 124 and through the down contact of switch 122 is diverted to ground through the SCR 186. The output transistor 132 of the photoisolator 130 is thereby made non-conductive and transistor 140 is made conductive to defeat the slow speed drive circuit and initiate braking action by bypassing current flow to diode 100 and resistor 102 to base of transistor 104. With the transistor 104 made non-conductive, the transistor 106 is made conductive to discharge the capacitor 110 into the gate of SCR 108, which triggers the SCR into conduction, short circuiting the armature winding 60 and passing current to the field windings 62 and 64 to initiate braking action.

If at any time finger pressure is removed from the up button 34 or the down button 36, the switch 122 returns to its null position and no current flows to the input LED 131 of photoisolator 130 or to base of transistor 156. Thus, the slow speed drive circuit is disabled and the needle bar release disable circuit is defeated. If the potentiometer 86 is not actuated, the braking arrangement is enabled and the sewing machine will stop.

I claim:

1. An electronically controlled sewing machine comprising a frame supporting an endwise reciprocatory and laterally oscillatable needle carrying needle bar, a feed system for feeding a work material through said sewing machine at a selected rate in a selected direction, means for urging said needle bar to selected lateral positions and for constraining said feed system to feed work material at a selected rate in a selected direction, means for actuating said needle bar into endwise reciprocatory motion and said feed system into feeding motion, a solid state memory means for retaining digital code words representative of needle stitch position and of feed increment from a previous stitch position in a sequence of stitches for a stitch pattern, an arm shaft position sensing means for sequentially releasing needle position and feed increment information from said memory to said urging and constraining means substantially at opposite extremes of said endwise reciprocatory motion of said needle bar for implementing said stitches to form a pattern, means for choosing one of a needle up and needle down position, means responsive to a signal from said choosing means for initiating slow speed operation of said actuating means, and means for fast stop braking of said actuating means in response to said arm shaft position sensing means sensing the position chosen by said choosing means.

2. A sewing machine as claimed in claim 1 wherein said actuating means further comprises a motor, a circuit means for selectively varying the speed of said motor, a slow speed circuit means for operating said motor at a slow speed when said varying circuit means is not operating, and means for shunting said slow speed circuit, said shunting means including a transistor switch for diverting current from said slow speed circuit means away from said motor; and wherein said initiating means further comprises means for disabling said shunting transistor switch.

3. A sewing machine as claimed in claim 2 wherein said means for disabling said shunting transistor switch further comprises a second transistor disabling conduction of said shunting transistor switch by diverting current from the base thereof; and wherein said choosing means further comprises a three position switch for selecting one of a needle up position, a needle down position, and a null position, a power source, and means responsive to said arm shaft position sensing means sensing the position chosen by said three position switch for diverting power passing through said three position switch.

4. A sewing machine as claimed in claim 3 wherein said diverting means further comprises a first SCR and an inverted circuit responsive to said arm shaft position sensing means sensing one of said needle positions chosen by said three position switch other than said null position, for triggering said first SCR to bypass current from said second transistor so as to disable conduction thereof and a second SCR responsive to said arm shaft position sensing means sensing the other of said needle positions chosen by said three position switch other than said null position for triggering said second SCR to bypass current from said second transistor so as to disable the conduction thereof and thereby enable the conduction of said shunting transistor switch to divert current from said slow speed circuit means.

5. A sewing machine as claimed in claim 4 further comprising means responsive to an electronic signal for separating said needle bar from said actuating means encouraging endwise reciprocatory movement thereof, and means for diverting said electronic signal from said separating means during actuation of said three position switch to a position other than said null position.

* * * * *